United States Patent [19]

Whitney

[11] 4,454,615

[45] Jun. 19, 1984

[54] AIR PAD WITH INTEGRAL SECUREMENT STRAPS

[75] Inventor: John Whitney, Dorado Beach, P.R.

[73] Assignee: Medisearch PR, Inc., Guayama, P.R.

[21] Appl. No.: 374,152

[22] Filed: May 3, 1982

[51] Int. Cl.[3] ..... A47C 27/08

[52] U.S. Cl. ..... 5/449; 5/498

[58] Field of Search ..... 5/449, 450, 451, 453–456, 5/496, 498, 466

[56] References Cited

U.S. PATENT DOCUMENTS

| | | | |
|---|---|---|---|
| 1,841,410 | 1/1932 | Karr | 5/498 |
| 2,099,427 | 11/1937 | Karr | 5/498 |
| 3,467,081 | 9/1969 | Glass | 5/453 |
| 3,958,286 | 5/1976 | Rodinsky | 5/451 |
| 4,347,633 | 9/1982 | Gammons et al. | 5/453 |

*Primary Examiner*—Alexander Grosz

[57] ABSTRACT

In an inflatable pad or mattress, or a pad of fluid impervious material for holding fluids of any type, securement straps are provided of the same sheet of film material which is used to form the main portion of the pad. The securement straps are designed to fit around and under the corners of a standard bed mattress to hold the pad in position on the mattress. The film material which forms the main body of the pad is die cut such that four straps are provided at each of the four corners of the pad with each strap being connected to the pad at approximately the center of the ends of the pad and at a point along the side of the pad spaced from the corner.

3 Claims, 2 Drawing Figures

FIG. 1.
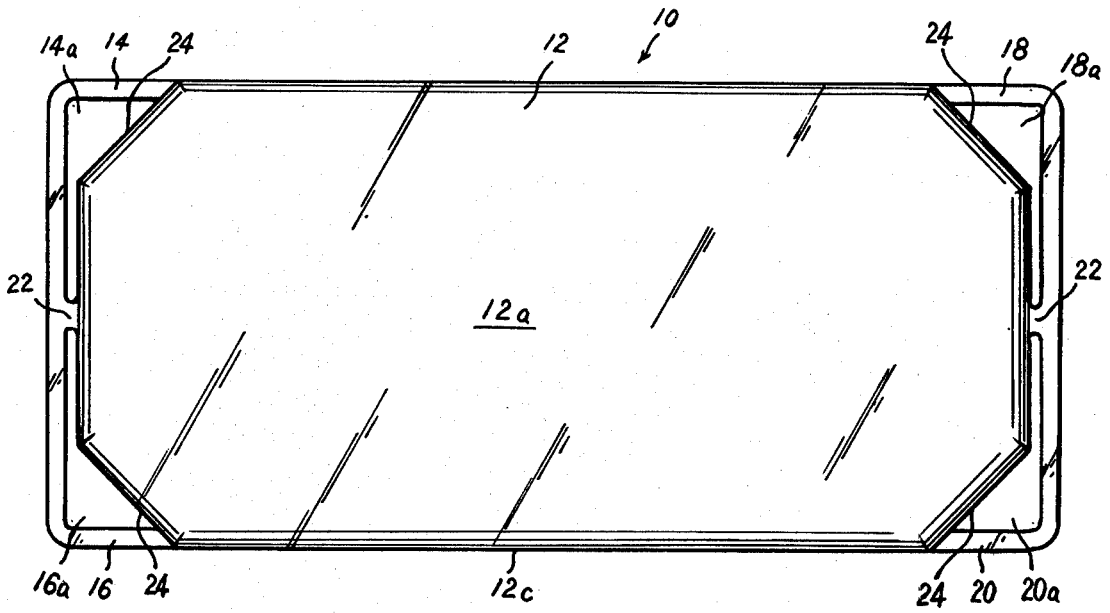
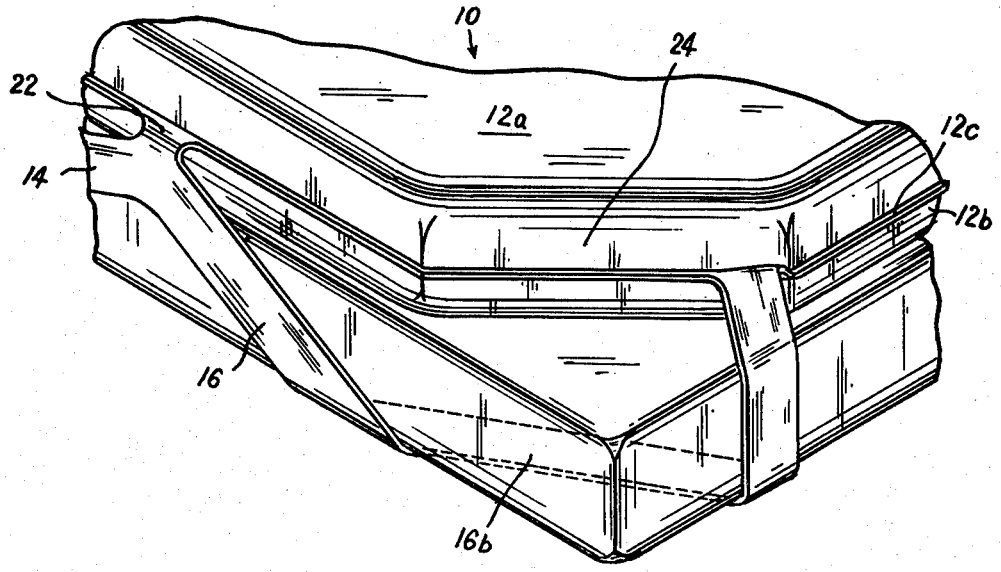
FIG. 2.

AIR PAD WITH INTEGRAL SECUREMENT STRAPS

This invention relates generally to fluid containing pads normally used in hospital and nursing care situations, and particularly to inflatable air pads used as mattresses or mattress pads. It also relates to similar pads containing other fluids such as water, mud, gels and cooling or heating agents.

In the health care field, fluid containing pads are used for many purposes including prevention of decubitus ulcers, patient comfort, heating and cooling and for other purposes. Typically, such pads are made from heat sealable plastic film material formed in two or more layers which are sealed together to create a fluid containing chamber. These pads are often provided with skirts or selvedge material by which the health care attendant may secure the pad in position on a bed. Typically, safety pins are inserted through the skirts of the pad and into the bed sheet or to the mattress cover. Both the attachment and removal of the pads by this manner is bothersome and, in addition, presents the risk of the pins puncturing and therefore destroying the fluid containing bag. In some fluid impervious pads used in situations where the patient sits up, the securement problem is particularly manifested in the migration of the pad downwardly on the bed. When the head of the bed is raised, or when the patient otherwise sits up, there is a tendency for the pad to be pushed toward, and possibly off, the foot of the bed. The force involved can be considerable and, therefore, firm and strong securement means are needed.

A need has existed for a better physical arrangement for securing these fluid containing pads to a hospital bed. Since these pads are normally low priced and are often disposable, it is necessary that the securement means be simple and low priced.

Accordingly, it is the object of the present invention to provide a structure for fluid containing pads by which the pads may be securely positioned on a mattress. It is a further object of the invention to provide such a structure which is both efficient and easy to employ and which is of low cost.

In accordance with one presently preferred embodiment of the invention, there is provided as part of a fluid impervious pad securement means formed out of the film material of the pad itself comprising four straps of one or more layers of film material, one strap located at each of the four corners of the pad. Each of the straps extends from approximately the center of one of the ends of the pad, around the corner of the pad, to a point along the side of the pad spaced from the corner. In use, the pad is placed on a bed and the four straps are pulled downwardly over the edges of the corners and the middle portion of the strap is positioned underneath the mattress, thus securing the pad to the mattress at the center of each end of the pad and at two points along each side of the pad.

The above brief description, as well as other objects, features and advantages of the present invention, will be best understood by reference to the following description when taken in conjunction with the accompanying drawings, wherein:

FIG. 1 is a plan view of a fluid containing bag manufactured in accordance with the present invention; and FIG. 2 is a partial perspective view of one corner of the pad shown in FIG. 1 when the pad is inflated and positioned on a mattress.

As shown in FIG. 1, a fluid impervious pad 10 consists of a main pad portion 12 and securement straps 14 and 16 at one end and 18 and 20 at the other end. The main portion of the pad is formed of an upper layer **12*a* and a lower layer 12*b* which are joined together at a heat seal 12*c* extending around the entire periphery of the pad. In use, the pad is filled with a fluid, such as air, water, a gel or the like for providing comfortable support, heating, cooling or some other benefit. The pad may be provided with internal division such that it controls the flow of fluid or it may be provided with alternate sets of internal cells to function as an alternating pressure pad. In short, the main pad portion 12** may be of any type of pad which is used as a supplemental pad on top of a mattress or table and which is constructed of two or more sheets of film material.

The function of securement straps 14, 16, 18, 20 is to simply and easily allow the pad 10 to be placed on and secured to a bed mattress (or other horizontal support for a patient such as a treatment table, operating table or stretcher). The straps themselves are formed of the same sheet of film material which forms the top and bottom layers **12*a*, 12*b* of the pad 10. Specifically, in the manufacture of the pad, openings 14*a*, 16*a*, 18*a*, and 20*a* are formed by die cutting or the like adjacent each corner of the pad 10 leaving a narrow strap portion between the main pad portion 12 and the edge of the sheet of film material. At the same time as the peripheral seal 12*c* is formed in the top and bottom sheets 12*a*, 12*b*,** the sheet material of the straps is sealed together.

The cut-out portions **14*a*, 16*a*, 18*a* and 20*a* are shaped to leave a bridge portion 22 at the center of each end of the main pad portion 12, attaching each of the securement straps to the main pad portion at the center of one of the ends of the pad. The other ends of the straps are secured to the sides of the main pad portion at a point spaced from the corner of the pad. In this instance, the cut-outs 14*a*, 16*a*, 18*a* and 20*a* are shaped to produce diagonal corners 24 at each of the four corners of the main portion of the pad 12. It is at the side end of the diagonal corner 24 that the securement straps are attached to the sides of the main pad portion. Other specific designs may also be used. For example, the straps may extend individually from separate locations at the end of the pad rather than from a joint attachment like the bridge portion 22** and they may join the side of the pad along the straight side edge at any location which provides sufficient length of strap to fit around and under the corner of a mattress.

In use, the fluid tight pad 10 is placed on a mattress, such as the mattress shown in FIG. 2, and either before or after the pad 10 has been filled with its working fluid, the straps 14, 16, 18, 20 are pulled down over the corner of a mattress and a portion of the straps, such as **16*b* in FIG. 2, is positioned under the mattress. As seen in FIG. 2, the strap 16 thus extends from its attachment point 22 at the center of one end of the main pad portion 12 following a sloping angle down to the point where it turns under the mattress, it proceeds along the bottom of the mattress as shown at strap portion 16*b* and then turns upwardly to the point at which it joins the main pad portion 12** along the side of the pad. The same situation exists at the other three corners of the pad.

Securement straps 14, 16, 18 and 20 of the present invention are extremely inexpensive to include on pads of this type. In fact, there is essentially no cost of materials for this securement means; the costs only relate to the tooling costs for forming the cut-outs 14*a*, 16*a*, 18*a* and 20*a* and the tooling cost associated with heat sealing the straps. This is so because the securement straps use no more film material than the standard pinning skirts which have been traditionally provided along the edges of such pads. Indeed, in some instances, the amount of film material used on this construction may be less than that compared with the amount of film employed in a pad having the standard pinning skirt.

Provision of the integral securement straps in accordance with the invention need be provided only at one end of the pad in some situations. For example, in an alternating pressure pad or other pad which is positioned beneath a bed sheet, the most significant securement problem relates to migration of the pad toward the foot end of the bed. In that instance, securement straps need be provided only at the head end of the bed. Such a pad would be mounted on the bed mattress by looping the securement straps around and under the two head end corners of the mattress and the bed sheet would then be placed over the bed. The integral straps, in such a situation, provide far more strength and security in holding the pad in position on the mattress, at less cost, fuss and bother, than existing arrangements.

It has been found that employment of this device makes the mounting of fluid-type pads on a hospital bed easier and quicker than as existed in the past and that the positioning of the pad on the bed is dependably secure. The elimination of safety pins around the edges of the bed, as was required in the prior art, promotes safety, eliminates the possibility of puncturing the pad with one of the pins, and very much simplifies the task of changing the bed linens.

The above description relates to a presently preferred embodiment of the invention. Many other specific designs for incorporating such hold-down straps on pads made of film material may be made without departing from the spirit and scope of the invention.

What I claim is:

1. A rectangular fluid-tight pad of the type formed of sheets of film material and intended for use on a rectangular mattress, including in combination securement straps at at least two of the four corners of said pad formed out of at least one of said sheets of film material forming said pad and therefore homogeneous therewith, each of said straps at said corners of said pad extending from the ends of said pad adjacent the center thereof and from the side of said pad at a point spaced from the corner, said straps being of a length, flexibility and configuration to be positioned around and under a corner of said mattress to secure said pad thereto.

2. A pad in accordance with claim 1 wherein there are four securement straps, one at each corner of said pad.

3. A rectangular fluid-tight pad of the type formed of sheets of film material and intended for use on a rectangular mattress, including in combination securement straps at the four corners of said pad formed out of at least one of said sheets of film material and therefore homogeneous therewith, each of said straps at said corners of said pad extending from the end of said pad adjacent the center thereof and from the side of said pad at a point spaced from the corner and a triangular shaped portion of said film material between said end of said pad adjacent the center thereof and said side of said pad at a point spaced from the corner being removed thereby eliminating the corners of said pad and permitting said straps to be positioned around and under a corner of said mattress to secure said pad thereto.

* * * * *